US005727611A

United States Patent [19]

Kalliokoski

[11] Patent Number: 5,727,611

[45] Date of Patent: Mar. 17, 1998

[54] METHOD FOR ADJUSTING BLADE CLEARANCE IN A DISC CHIPPER AND AXIAL GUIDE BEARING SYSTEM OF A DISC CHIPPER

[75] Inventor: Alpo Kalliokoski, Pori, Finland

[73] Assignee: Sunds Defibrator Woodhandling Oy, Pori, Finland

[21] Appl. No.: 768,973

[22] Filed: Dec. 18, 1996

[30] Foreign Application Priority Data

Dec. 22, 1995 [FI] Finland ..... 956202

[51] Int. Cl.[6] ..... B27C 1/00

[52] U.S. Cl. ..... 144/329; 144/162.1; 144/176; 144/370; 241/92; 241/259.1; 241/296; 241/298; 384/428; 384/441

[58] Field of Search ..... 144/162.1, 176, 144/329, 363, 369, 370; 384/428, 441, 434; 29/898, 898.04, 898.041; 241/92, 259.1, 292.1, 296, 297, 298

[56] References Cited

U.S. PATENT DOCUMENTS 4,390,132 6/1983 Hutson et al. ..... 241/79
4,480,667 11/1984 Vaittinen et al. ..... 144/176

*Primary Examiner*—W. Donald Bray
*Attorney, Agent, or Firm*—Burns, Doane, Swecker & Mathis, L.L.P.

[57] ABSTRACT

A method for adjusting the blade clearance in a disc chipper by moving in the axial direction a bearing bushing of a disc shaft together with the bearing. The axial movement of the shaft is effected by loosening adjusting screws or adjusting nuts of one of the end caps of the axial guide bearing housing and by tightening after this the adjusting screws or adjusting nuts of the other end cap. The cap then pushes the axial guide bushing and the attached shaft in the axial direction by way of a guide projection on the surface of the cap facing towards the bearing. An axial guide bearing system includes a shaft supporting a blade disc of a disc chipper, with the shaft and blade disc being movable relative to a counter blade in an axial direction. The system also includes a bearing housing frame and a bearing fixed to the shaft and movable with respect to the bearing housing frame. A pair of end caps is detachably secured to opposite ends of the bearing housing frame and a pair of guide projections extend between one of the end caps and the bearing. The outer surface of the bearing housing frame is shorter in the axial direction than the structure formed by the bearing and the guide projections.

13 Claims, 3 Drawing Sheets

METHOD FOR ADJUSTING BLADE CLEARANCE IN A DISC CHIPPER AND AXIAL GUIDE BEARING SYSTEM OF A DISC CHIPPER

FIELD OF THE INVENTION

The present invention concerns a method for adjusting the blade clearance in a disc chipper. The invention also concerns an axial guide bearing system.

BACKGROUND OF THE INVENTION

For making the chip to be used in pulp production, there are generally used chippers with an adjustable blade clearance. When the blade clearance is too small, there is the risk that the counter blade and the cutting blade touch each other. Increasing the clearance deteriorates significantly the quality of the chip as the share of sawdust and sticks increases. A typical blade clearance is from 0.5 to 0.8 mm.

Chippers are generally used, in which the blade clearance is adjusted by moving the counter blade or by moving the blade disc and its shaft.

The counter blade of a chipper must be fixed tightly in order to keep the blade clearance as adjusted during the chipping. For this reason, the constructions of the adjusting system of the counter blade are robust and the adjustment of the counter blade is difficult and takes much time.

Present methods, in which the blade disc and its shaft are moved in order the adjust the blade clearance, are complicated. The axial guide bearing housing consists of several parts, and when the parts give way, the blade clearance does not stay at the exactly adjusted dimension. There are also methods, in which the blade disc is moved by using hydraulic actuators. These naturally increase the purchasing costs of the chipper. One drawback of the above mentioned methods is also the need of special tools.

SUMMARY OF THE INVENTION

An object of the present invention is to provide a simple and easily feasible adjustment of the blade clearance. The construction must also be stable in order to keep the blade clearance as adjusted during the chipping. The method in accordance with the invention is characterized in that the movement of the shaft in its axial direction is effected by loosening the adjusting screws or adjusting nuts of one of the two end caps of the axial guide bearing housing and by tightening after that the adjusting screws or adjusting nuts of the other end cap, whereby the cap pushes the axial guide bearing and the shaft attached thereto in the axial direction by means of a guide projection located on the surface of the cap facing towards the bearing. The axial guide bearing in accordance with the invention is characterized in that the outer surface of the frame of the bearing housing, said outer surface being attached immobile in relation to the frame of the chipper, is in its axial direction shorter than the entity formed by the bearing and the guide projections located on both sides of the bearing between the bearing and the cap. No special tools are required for the method, but the adjustment is made by a usual nut key.

BRIEF DESCRIPTION OF THE DRAWING FIGURES

The invention and its details are described in more detail in the following with reference to the enclosed drawings, wherein FIG. 1 illustrates the construction, the blade disc and the chipper frame of the axial guide bearing of a chipper known in the art, FIG. 2 illustrates an axial guide bearing system of another type known in the art, FIG. 3 illustrates a chipper's axial guide bearing system according to the present invention, and FIG. 4 illustrates an alternative assembly of a chipper's axial guide bearing according to the present invention.

DETAILED DESCRIPTION OF THE INVENTION

Figure 1:
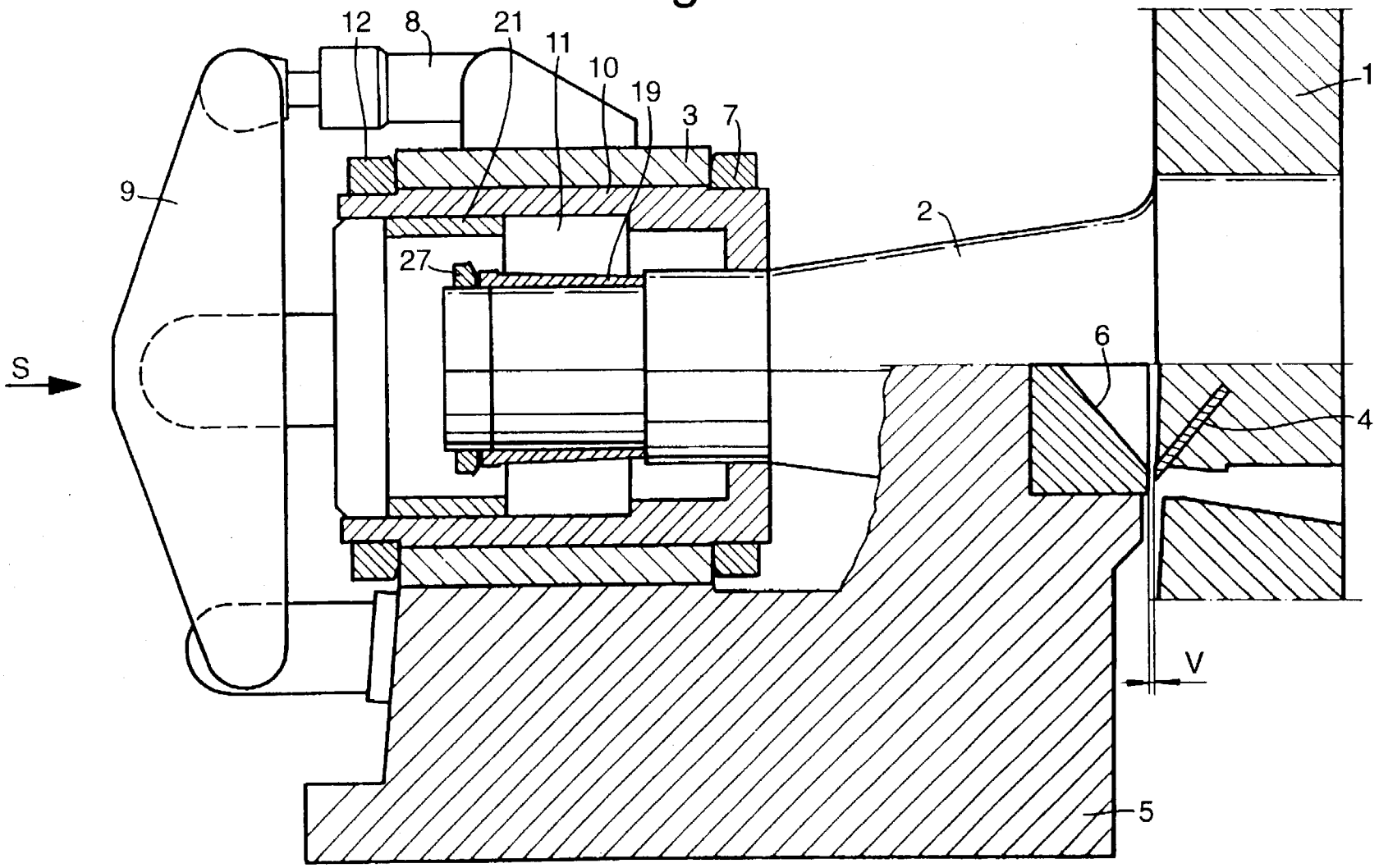

In FIG. 1 there is illustrated a blade disc 1, a shaft 2 of the blade disc and an axial guide bearing housing 3 of a chipper. A blade 4 is attached to the blade disc 1. A counter blade 6 is attached to the frame 5 of the chipper. The distance between the blade 4 and the counter blade 6 in the axial direction of the shaft 2 is called clearance V.

The clearance V is adjusted to be e.g. 0.2 mm bigger by moving the shaft 2 and the disc 1 in the direction of the arrow S as follows. A nut 12 with a big diameter is opened by a special tool for a distance that is known to correspond to a movement of 0.2 mm of the shaft 2 in direction S. After that, an inner bearing housing 10 is moved in the direction of the arrow S by using a hydraulic cylinder 8 by means of a lever arm 9. A bearing 11 has been locked to the shaft 2 by means of a clamping bushing 19 and a nut 27 and to the inner bearing housing 10 by means of a clamping bushing 21, so that along with the inner bearing housing, the shaft and the blade disc 1 move in the direction of the arrow S. Finally, the nut 7 is tightened.

Figure 2:
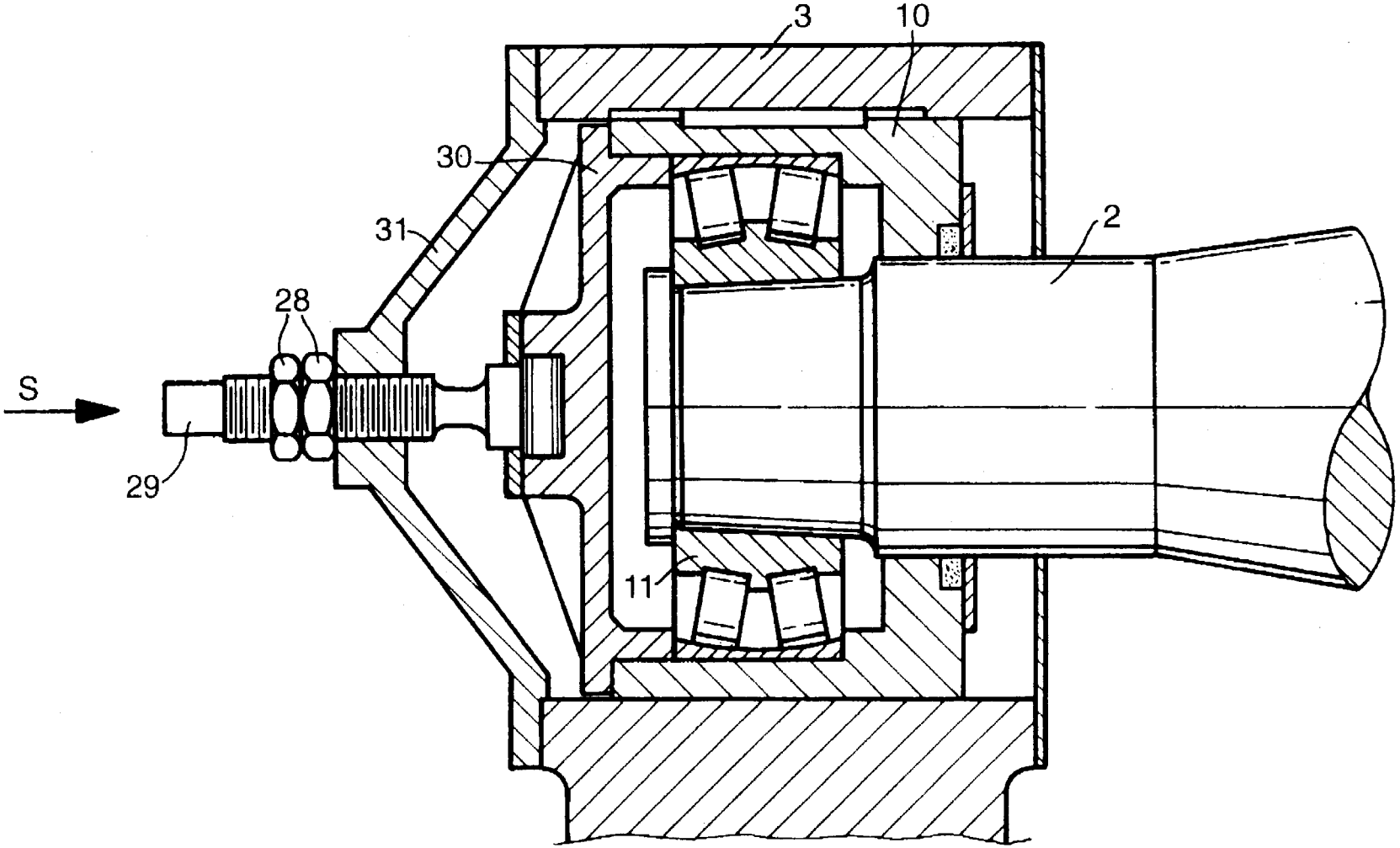

FIG. 2 illustrates another known axial guide bearing of a chipper. The blade clearance is increased by moving the shaft 2 in the direction of the arrow S. Nuts 28 are opened and the inner bearing bushing 10 is moved with a screw 29 by means of a flange 30 in the direction of the arrow S. The bearing 11 and the shaft 2 move along with the inner bearing housing 10. Finally, the nuts 28 are tightened.

The screw 29 also acts as a safety pin. When foreign bodies, e.g. metal pieces enter the chipper, the screw 29 breaks at its slimmest point and the blade disc moves farther from the counter blade, whereby e.g. the risk of the shaft 2 twisting or of other bigger damages is significantly decreased.

A disadvantage of the bearing system according to FIG. 2 is the fact that because the flanges 30, 31 flex, the blade clearance does not stay at its adjusted dimension. Additionally, for turning one big screw 29 a special key with a long arm is required, because one big screw requires a big turning moment.

Figure 3:
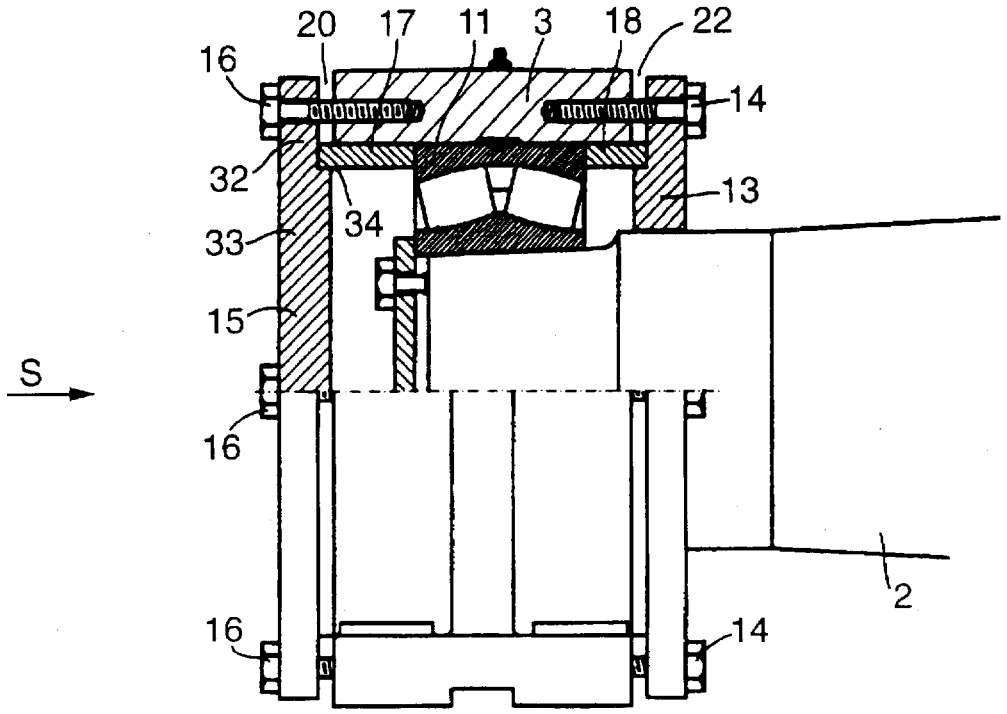

FIG. 3 illustrates a bearing system in accordance with the present invention. The frame 3 of the bearing housing is fastened to the frame of the chipper. The axial guide bearing 11 is locked to the shaft 2 supporting the blade disc and adapted to the bearing housing so that in the axial direction it can be slid in relation to the frame 3 of the bearing housing. The bearing housing has a front cap 15 and a cap 13 facing towards the blade disc. The peripheral part 32 of the caps 15 and 13 is thinner than the middle part 33 so that there is an inner shoulder 34 between the peripheral and the middle part. A front guide bushing 17 is fitted against the shoulder of the front cap 15, and a rear guide bushing 18 is fitted against the shoulder of the cap 13 facing towards the disc. The ends of both bushings have been fitted against the bearing 11 and the thinner peripheral part of the cap. Both of the caps are fixed to the bearing housing so that between the housing and the cap there is an axial gap 20, 22. The fixing has been effected by means of adjusting screws 14, 16 so that the dimension of the gaps can be adjusted.

For increasing the clearance V by 0.2 mm, the adjusting screws 14 of the cap 13 facing towards the blade disc 1 are opened by the measure corresponding to the measure that the clearance is wished to be increased. That causes a clearance between the rearmost guide bushing 18 and the cap 13 or the bearing 11. The shaft 2 is moved in the direction of arrow S by tightening the adjusting screws 16 of the foremost cap 15, whereby the cap 15 pushes the bearing 11 by means of the foremost guide bushing 17 towards the rearmost guide bushing 18. The rearmost guide bushing 18 further sets itself against the cap 13 facing towards the blade disc. When moving, the axial guide bearing 11 moves the shaft 2 that for its part moves the blade disc. The increasing of the blade clearance V can be checked with a feeler gauge at the gap 20, 22 between the axial guide bearing 3 and the respective cap 13, 15.

In the construction in accordance with the present invention, when foreign bodies enter the feeding funnel of the chipper, the damages of the blade disc and the shaft are avoided by dimensioning the screws 14 of the cap 13 facing towards the blade disc to break with excessive axial forces.

Figure 4:
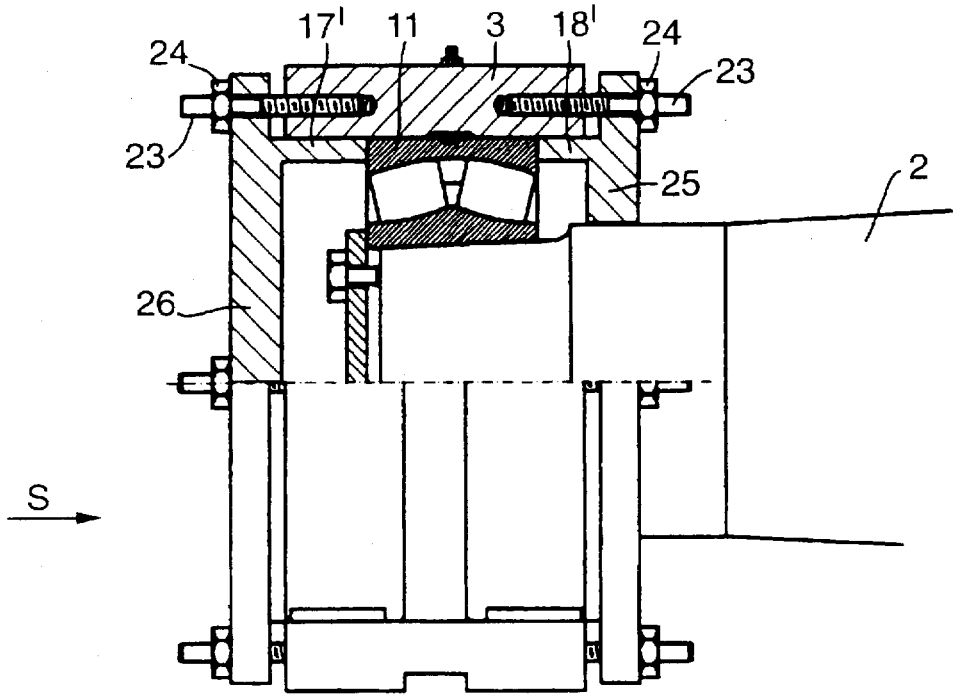

In the construction in accordance with the present invention, stud bolts 23 and nuts 24 can be used alternatively (FIG. 4), whereby the movement is effected by means of the nuts. Alternatively, the cap of the bearing housing and the guiding bushing can consist of one piece 25, 26.

I claim:

1. A method for adjusting blade clearance in a disc chipper that includes a blade disc mounted on a shaft, a bearing attached to the shaft, a bearing housing which houses the bearing, a first cap positioned on one side of the bearing and connected to the bearing housing by a first adjusting mechanism, a second cap positioned on an opposite side of the bearing and connected to the bearing housing by a second adjusting mechanism, and a guide projection extending between the first cap and the bearing, the method comprising the steps of:

loosening the second adjusting mechanism to axially move the second cap;

tightening the first adjusting mechanism to axially move the first cap so that the first cap pushes the bearing and the attached shaft in the axial direction by way of the first guide projection.

2. A method according to claim 1, wherein the first guide projection is a guide bushing which bears against a shoulder located on a surface of the first cap which faces the bearing.

3. A method according to claim 1, wherein said first adjusting mechanism is breakable upon application of an excessive axial force.

4. A method according to claim 1, wherein the first and second adjusting mechanisms are adjusting screws, said steps of loosening the second adjusting mechanism and tightening the first adjusting mechanism including rotating the adjusting screws.

5. A method according to claim 1, wherein the first and second adjusting mechanisms are adjusting nuts, said steps of loosening the second adjusting mechanism and tightening the first adjusting mechanism including rotating the adjusting nuts.

6. An axial guide bearing system, comprising:

a shaft supporting a blade disc of a disc chipper, said shaft and blade disc being movable relative to a counter blade in an axial direction;

a bearing housing frame, said bearing housing frame having an outer surface;

a bearing fixed to the shaft and movable with respect to the bearing housing frame;

a pair of end caps detachably secured to opposite ends of the bearing housing frame;

a pair of guide projections, each guide projection extending between one of the end caps and the bearing;

said outer surface of the bearing housing frame being shorter in the axial direction than an entity formed by the bearing and the guide projections.

7. An axial guide bearing system according to claim 6, wherein the guide projections are guide bushings slidably fitted against an inner surface of the bearing housing frame.

8. An axial guide bearing system according to claim 7, wherein the guide bushings are separate from the end caps.

9. An axial guide bearing system according to claim 7, wherein each of the guide bushings is formed in one piece with one of the end caps.

10. An axial guide bearing system according to claim 6, including a pair of adjusting mechanisms each connecting one of the end caps to the bearings.

11. An axial guide bearing system according to claim 10, wherein the adjusting mechanisms are adjusting screws.

12. An axial guide bearing system according to claim 10, wherein each of the adjusting mechanisms includes a bolt and a nut.

13. An axial guide bearing system according to claim 6, wherein each of the end caps includes a shoulder, each guide projection being supported on the shoulder of one of the end caps.

* * * * *